United States Patent [19]

Lanz et al.

[11] 4,086,966

[45] May 2, 1978

[54] COMPOSITE GROUND ENGAGING TOOL

[75] Inventors: William E. Lanz, Joliet; Harris S. Olson, Morton, both of Ill.

[73] Assignee: Caterpillar Tractor Co., Peoria, Ill.

[21] Appl. No.: 752,580

[22] Filed: Dec. 20, 1976

[51] Int. Cl.[2] ..... E02F 3/76

[52] U.S. Cl. ..... 172/767; 172/747; 37/141 R; 428/558

[58] Field of Search ..... 172/747, 767, 719, 735; 37/141 R, 42 R

[56] References Cited

U.S. PATENT DOCUMENTS

| | | | |
|---|---|---|---|
| 1,922,917 | 8/1933 | Russell | 172/767 |
| 2,549,088 | 4/1951 | Hettelsater | 172/747 |
| 3,529,677 | 9/1970 | Stephenson | 172/767 |
| 3,934,654 | 1/1976 | Stephenson | 172/767 |

OTHER PUBLICATIONS

German Printed App. No. 2,423,963, 12/12/1974, Caterpillar.

*Primary Examiner*—Richard J. Johnson
*Attorney, Agent, or Firm*—Charles E. Lanchantin, Jr.

[57] ABSTRACT

A composite ground engaging tool is disclosed including a first plate having leading and trailing end portions, first and second surfaces, and a cutting edge on the leading end portion, a second plate having leading and trailing end portions, first and second surfaces, and a cutting edge on the leading end portion, the plates being substantially coextensive and of a construction sufficient for spacing the leading end portions from each other during contacting of the first surfaces and being connected together to define a deep slot between them, and a wear-resistant member disposed within the slot and secured to the plates.

4 Claims, 2 Drawing Figures

COMPOSITE GROUND ENGAGING TOOL

BACKGROUND OF THE INVENTION

It is known in the art to provide ground engaging or earth penetrating tools with inserts of materials which have a higher degree of wear-resistance than the tool material, which is usually of steel. Such inserts are employed to prolong the life of these tools, and much ingenuity has been exercised in the placement of these inserts within the tool to obtain the greatest wear life possible. Furthermore, while some of these inserts have been meltably deposited in a groove of the tool as by welding or the like, other inserts have been separately formed and then secured within a cavity of the tool as by brazing them in place.

In addition to the problem of properly positioning the wear-resistant inserts in a protected location on the tool relative to its normal travel direction, the tool has often had an insufficient service life because the inserts secured to the tool have been of insufficient size. For example, in the case of a cutting edge for a motor grader, such as is disclosed in U.S. Pat. No. 3,529,677 and issued Sept. 22, 1970 to E. W. Stephenson, the inserts have been limited in size due to the relatively shallow depth of the groove which receives them. Particularly, the groove has been heretofore unduely shallow because it has not been economically feasible to machine a groove depth greater than approximately 1 inch in the center of the leading edge of the blade.

SUMMARY OF THE INVENTION

The present invention is directed to overcoming one or more of the problems as set forth above.

According to the present invention, a ground engaging tool has a pair of plates individually having leading and trailing end portions and a cutting edge. The plates are secured to each other and constructed and arranged so that the leading end portions are spaced from each other to define a slot. A wear-resistant member is secured within the slot.

DESCRIPTION OF THE PREFERRED EMBODIMENT

Figure 1:
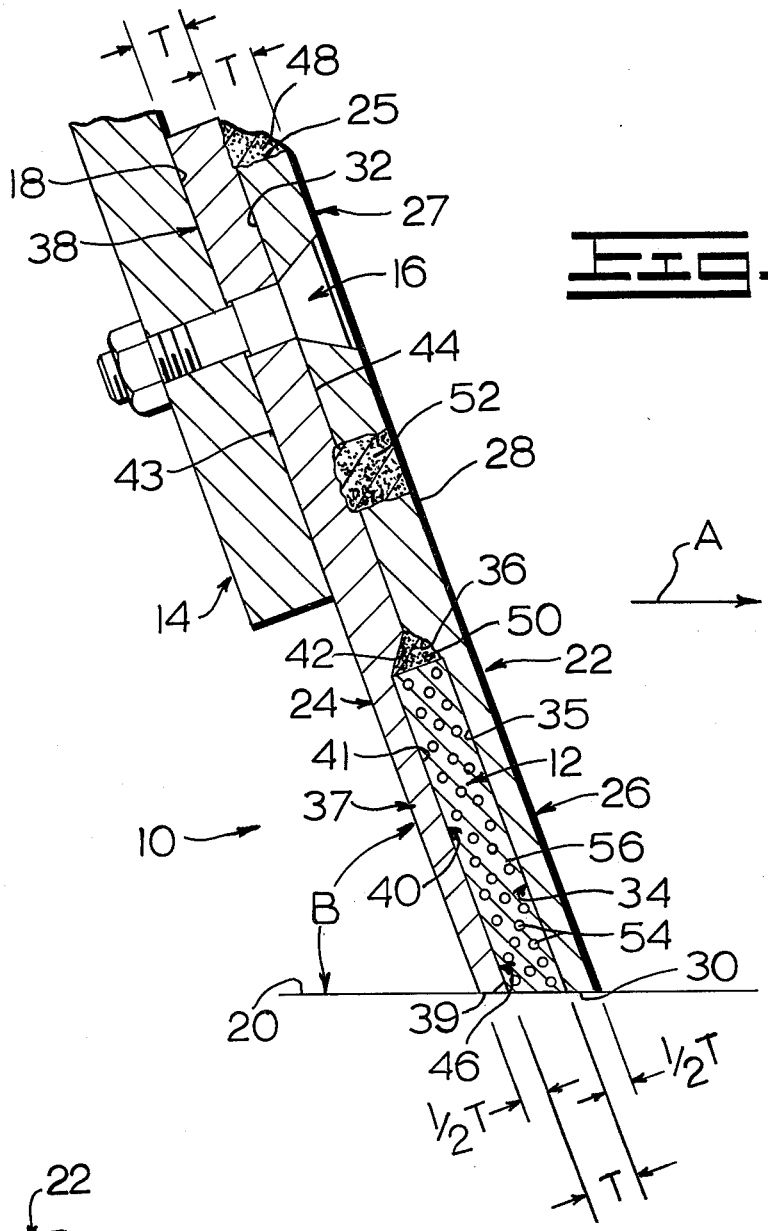
FIG. 1 is a fragmentary vertical longitudinal section of the preferred embodiment of the composite ground engaging tool of the present invention as removably installed on a conventional motor grader moldboard.

With reference to FIG. 1, a ground engaging tool or composite blade 10 is shown as having a wear-resistant member or insert 12 situated centrally within it in a relatively protected location. While the blade is of elongate configuration substantially at right angles to the normal direction of blade movement, as indicated by the arrow identified by the letter A in the drawing, and the blade is shown on a motor grader cutting edge support or moldboard 14, it is to be appreciated that such construction is applicable to other ground engaging tools as well.

In the instant example, however, the composite blade 10 is removably secured to the moldboard 14 by a plurality of fasteners or plow bolt and nut assemblies 16 of conventional constuction which extend through suitably aligned apertures therethrough. Upon screw threaded release of the fasteners, the blade may be replaced in the usual manner after an extended service life. It is to be noted that the moldboard has a front face or surface 18 thereon which is typically angled forwardly and downwardly with respect to a substantially horizontal ground line 20. For example, in order to enable the tool 10 to better move earth, snow or the like, an inclination angle identified by the letter B is frequently utilized.

In accordance with the present invention, the composite blade 10 is composed of three major portions, namely a first plate 22, a second plate 24 integrally secured to the first plate in a substantially coextensive manner, and the wear-resistant insert 12 protectively secured integrally between them. Both of these plates are preferably of hot rolled, low or medium carbon steel and of transversely enlongated construction, and with the first plate being somewhat foreshortened to form an exterior step 25 at the upper end thereof with respect to the second plate.

The first or front plate 22 includes a leading end portion 26, a trailing end portion 27, a load carrying front face or surface 28 and a lower cutting edge 30 defined on the leading end portion. The front plate further has a rear surface 32 which is substantially parallel to the front face thereof to define a plate having a predetermined thickness as identified by the letter T in the drawing. According to one aspect of the invention, the front plate also has a step-like depression or rearwardly facing recess 34 which is defined generally in the leading end portion by a transversely extending rear face 35 and an inclined transitional surface 36. Preferably, the thickness between the front face 28 and rear face 35 is equal to one-half the thickness T at the upper end of the plate as indicated.

In a corresponding manner, the second or rear plate 24 includes a leading end portion 37 and a trailing end portion 38 with an overall thickness at the upper end thereof which is substantially the same as the front plate 22. At its lower end it has a cutting edge 39 with a step-like depression or forwardly facing recess 40 opening thereon which is defined by a front face 41 and an inclined transitional surface 42. As is clearly shown by the drawing, the first plate has a rear surface 43 which makes planar seated engagement with the surface 18 of the moldboard 14, and a front surface 44 which contacts the rear surface 32 of the front plate. In this way the first and second plates are secured together in facing engagement so that the depressions 34 and 40 are congruous to cooperatively define a relatively deep and narrow slot 46 between them.

The plates 22 and 24 are preferably weldably secured together as by an elongated weld joint 48 disposed along the step 25 at the upper end thereof, and by an elongated weld joint 50 disposed within the inner base of the slot 46 adjacent the upwardly converging transitional surfaces 36 and 42. While these two weld joints may be sufficient in some instances, a plurality of plug welds, generally indicated by the reference numeral 52, may be utilized to more rigidly secure the plates together.

In accordance with one aspect of the invention, the wear-resistant insert 12 is made of a composite material consisting essentially of a plurality of wear-resistant particles 54 embedded in a carrying matrix 56. It is to be understood that the term "wear-resistant" as used herein shall mean those materials having substantially high average hardness levels and a resistance to abrasion which is greater than the material composition of the plates 22 and 24. In the instant example the particles are made from a relatively low-carbon, chromium-iron based alloy having a predetermined amount of boron therein. A preferred proportion thereof by weight is 58% chromium and 8% boron, and the remainder iron. The complex mixture of iron and chromium borides thus provided has an extremely high hardness value. The particle carrying matrix, on the other hand, preferably has an iron-boron matrix of eutectic composition. In such instance, the boron is controlled to a level of approximately 3.8% to provide an alloy having a relatively fine ferritic microstructure and a high average hardness due to the boron needles therein.

After the plates 22 and 24 are secured together as by the welds 48, 50 and 52, the wear-resistant insert 12 is fully brazed or otherwise bonded in place within the slot 46. Preferably a copper based brazing material is utilized which contains a predetermined proportion of manganese and nickle therein.

DESCRIPTION OF AN ALTERNATE EMBODIMENT

Figure 2:
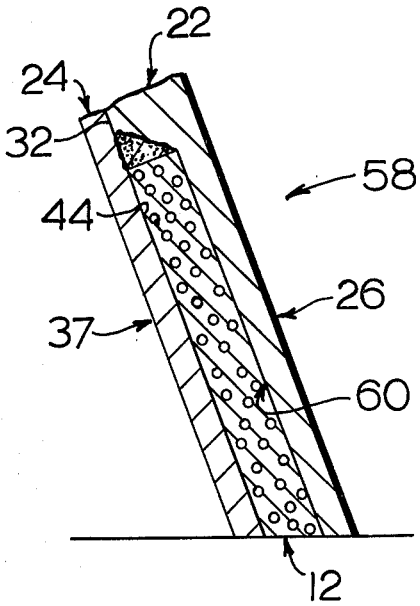
FIG. 2 is a fragmentary vertical longitudinal section of an alternate embodiment tool which is constructed in accordance with the present invention.

As clearly shown in FIG. 2, an alternate embodiment composite blade 58 is shown which differs only in the location of the insert 12 relative to the front and rear plates 22 and 24. Specifically, while the plates still have a construction sufficient for spacing the leading end portions 26 and 37 apart from each other during contact of the surfaces 32 and 44, a step-like depression 60 is defined solely in the front plate for receiving the insert.

In view of the foregoing, it is readily apparent that the ground engaging tool 10 of the present invention provides an improved three-piece blade construction with a relatively deep wear-resistant insert 12 therein. Moreover, the insert extends downwardly and outwardly to form with the plates a sandwich cutting edge portion with an extended wear life. With this construction, the insert is protectingly disposed between the thinner but still sturdy lower end portions of the steel plates.

While the invention has been described and shown with particular reference to a preferred and alternate embodiment, it will be apparent that variations might be possible that would fall within the scope of the present invention, which is not intended to be limited except as defined in the following claims.

The embodiments of the invention in which an exclusive property or privilege is claimed are defined as follows:

1. A composite ground engaging tool comprising:

a first plate having leading and trailing end portions, first and second substantially planar surfaces, and a cutting edge on the leading end portion;

a second plate having leading and trailing end portions, first and second substantially planar surfaces, and a cutting edge on the leading end portion, the plates being substantially coextensive and of a construction sufficient for spacing the leading end portions from each other during contacting of the first planar surfaces and defining a deep slot and an inwardly defined base of the slot therebetween;

means connecting the plates together with the first planar surfaces contacting one another, said means including at least one internal weld joint located at said base of the slot and spaced from said second planar surfaces; and a wear-resistant member disposed within the slot and secured to the plates.

2. The tool of claim 1 wherein the second plate forms an exterior step with the first plate and said means includes an exterior weld joint disposed along said step and connecting the plates together.

3. The tool of claim 1 wherein said plates individually define a depression therein which open outwardly on the cutting edges thereof.

4. The tool of claim 1 wherein said means includes a plurality of plug welds securing the first and second plates one to the other.

* * * * *